US006719490B2

(12) United States Patent
Maestro

(10) Patent No.: US 6,719,490 B2
(45) Date of Patent: Apr. 13, 2004

(54) STORMWATER RECEIVING ASSEMBLY

(76) Inventor: Robert M. Maestro, 12301 Beechnut Ct., Woodbridge, VA (US) 22192-2002

( * ) Notice: Subject to any disclaimer, the term of this patent is extended or adjusted under 35 U.S.C. 154(b) by 0 days.

(21) Appl. No.: 10/330,595

(22) Filed: Dec. 30, 2002

(65) Prior Publication Data

US 2003/0095838 A1 May 22, 2003

Related U.S. Application Data

(63) Continuation-in-part of application No. 09/836,595, filed on Apr. 18, 2001, now Pat. No. 6,612,777.

(51) Int. Cl.[7] ..... E02B 11/00; E02B 13/00
(52) U.S. Cl. ..... 405/46; 405/49; 405/43
(58) Field of Search ..... 405/36, 39–49, 405/51

(56) References Cited

U.S. PATENT DOCUMENTS 980,442 A * 1/1911 Schlafly ..... 405/48
4,869,032 A * 9/1989 Geske ..... 52/169.5
6,361,248 B1 3/2002 Maestro
2003/0118405 A1 * 6/2003 Sakamoto ..... 405/46

* cited by examiner

*Primary Examiner*—Heather Shackelford
*Assistant Examiner*—Sunil Singh
(74) *Attorney, Agent, or Firm*—Norman B. Rainer

(57) ABSTRACT

A stormwater receiving assembly for processing stormwater containing suspended particulate matter includes a dispensing chamber and an underlying accumulating accessory. The dispensing chamber is fabricated of thin-walled plastic contoured as a corrugated wall horizontally elongated between inlet and exit ends and having an arched cross-sectional shape with upwardly directed peak and spaced apart parallel lowermost edge extremities defining an open bottom. A circular portal is located in the peak of the chamber. The accumulating accessory has a compartment bounded by sidewall structure elongated upon a vertical axis between upper and lower extremities, and is positioned below the dispensing chamber such that the portal of the dispensing chamber is in centered vertical alignment with the lower extremity of the compartment of the accumulating accessory.

14 Claims, 3 Drawing Sheets

STORMWATER RECEIVING ASSEMBLY

RELATED APPLICATIONS

This Application is a Continuation-in-Part of U.S. patent application Ser. No. 09/836,595, filed Apr. 18, 2001, now U.S. Pat. No. 6,612,777.

BACKGROUND OF THE INVENTION

1. Field of the Invention

The present invention relates to the management of stormwater runoff, and more particularly concerns devices which minimize and facilitate sediment maintenance, expand the storage capacity of stormwater management systems, and facilitate the infiltration of stormwater into the surrounding substrate.

2. Description of the Prior Art

Culverts, catch basins, and storm sewers are the common practices for collecting and conveying stormwater runoff. In some instances such water is discharged directly into the nearest available water body despite the potentially adverse environmental effects of such action. In some other instances, stormwater management facilities are constructed to help manage the quantity and quality of the stormwater. Wet or dry retention or detention basins/ponds represent the most common structural approach to stormwater management. Although more environmentally sound than direct discharge into an existing body of water, such stormwater management approaches preclude other uses of the land. This is of particular importance where land values are high and/or space is limited. The open ponds may also be undesirable in locations near airports because of birds attracted by the pond, or in locations where health, liability or aesthetic considerations make them undesirable. Even the use of "dry" detention basins frequently results in the same type of problems associated with wet ponds. Without proper maintenance, dry detention basins frequently transform into wet ponds.

Underground systems have also been developed to help manage stormwater effluent. Such systems include the use of plastic arch-shaped, open bottom stormwater chambers arranged end-to-end in rows. However, all current underground stormwater management systems are limited by the amount of area available for their installation. This is particularly relevant to the plastic stormwater chambers. The largest plastic chamber currently on the market has an arched cross-sectional area of 34 inches high by 60 inches wide and a length of eight and one half feet. The creation of larger chambers is limited by the forming capacity of molding machinery.

In a typical installation of plastic stormwater chambers, elongated hollow plastic chambers are emplaced in the ground to form a leaching field for receiving stormwater and dispensing the water into the surrounding earth. Such chambers have a central cavity for receiving inflow water. An open bottom, and apertures optionally located in the sides of the chambers provide the means whereby the water is allowed to exit the central cavity and disperse into the surrounding earth. The chambers are usually attached endwise to form long rows extending in side-by-side juxtaposition and seated upon a crushed rock substrate in a multirow array that constitutes a leaching field. The stormwater is generally conducted to the array of rows by a large diameter manifolded pipe system that runs orthogonally to the rows closely adjacent one extremity thereof.

Examples of stormwater dispensing chambers are disclosed in U.S. Pat. Nos. 5,017,041; 5,156,488; 5,336,017; 5,401,116; 5,441,363; 5,556,231 and 6,361,248.

Stormwater typically carries considerable amounts of suspended particulate material, commonly referred to as Total Suspended Solids (TSS), which eventually settles out as sediment within the stormwater management system. The accumulation of such sediment adversely affects the storage capacity of stormwater management facilities, decreasing their effective life. The effective life of such facilities can be significantly extended with a maintenance program for sediment removal. Such sediment removal can generally be achieved by a vacuuming operation conducted by a suitably equipped truck. In such operation, a tube is extended from the truck through a manhole, through an associated riser pipe, and into the bottom of the chamber. The sediment in the bottom of the chamber is then removed by vacuuming.

Unfortunately, the maintenance of stormwater management systems is typically neglected, and typically occurs only when the system fails or sediment accumulates to a point where flooding occurs because of diminished storage capacity of the system. This problem has become so serious that some municipalities have imposed a stormwater maintenance "fee" on property owners to help pay for private-sector stormwater facility maintenance.

Unlike stormwater wet and dry ponds, which are readily observable and accessible, removal of sediment from underground stormwater management facilities has historically been inherently more inconvenient and costly, resulting in resistance to their use by some municipalities. Some types of underground stormwater management facilities even have to be replaced in order to remove accumulated sediment.

It is accordingly an object of the present invention to improve the sediment handling capacity of an underground stormwater management system.

It is another object of this invention to provide an accumulating accessory interactive with a plastic stormwater dispensing chamber to increase the sediment handling capacity of an underground stormwater management system comprised of said chambers.

It is a further object of the present invention to provide a plastic stormwater dispensing chamber combined with an accumulating accessory in a manner to facilitate removal of accumulated sediment.

It is yet another object of this invention to provide a combined stormwater dispensing chamber and accumulating accessory of the aforesaid nature of durable, simple construction amenable to low cost fabrication and installation.

These objects and other objects and advantages of the invention will be apparent from the following description.

SUMMARY OF THE INVENTION

The above and other beneficial objects and advantages are accomplished in accordance with the present invention by a stormwater receiving assembly comprised of an accumulating accessory interactive with a stormwater dispensing chamber comprised of a plastic wall elongated between inlet and exit ends and having an arched cross-sectional shape with upwardly directed peak and spaced apart parallel lowermost edge extremities defining an open bottom, said wall having clean out portal means in said peak.

The accumulating accessory is comprised of a compartment bounded by sidewall structure elongated upon a vertical axis between upper and lower extremities, said upper extremity being open and having a perimeter disposed in a plane orthogonal to said axis.

The accumulating accessory is operatively positioned below said dispensing chamber in a manner such that the clean out portal means of the chamber is in centered vertical alignment with the lower extremity of said compartment.

In preferred embodiments, the sidewall structure of the compartment of the accumulating accessory is downwardly convergent toward its lower extremity which is closed by way of a bottom panel. The sidewall structure may be fabricated of four flat panels joined in an inverted pyramidal configuration having a rectangular upper extremity, and said panels may have apertures to permit water drainage. The size and configuration of said upper extremity is preferably such as to support the edge extremities of the overlying chamber.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
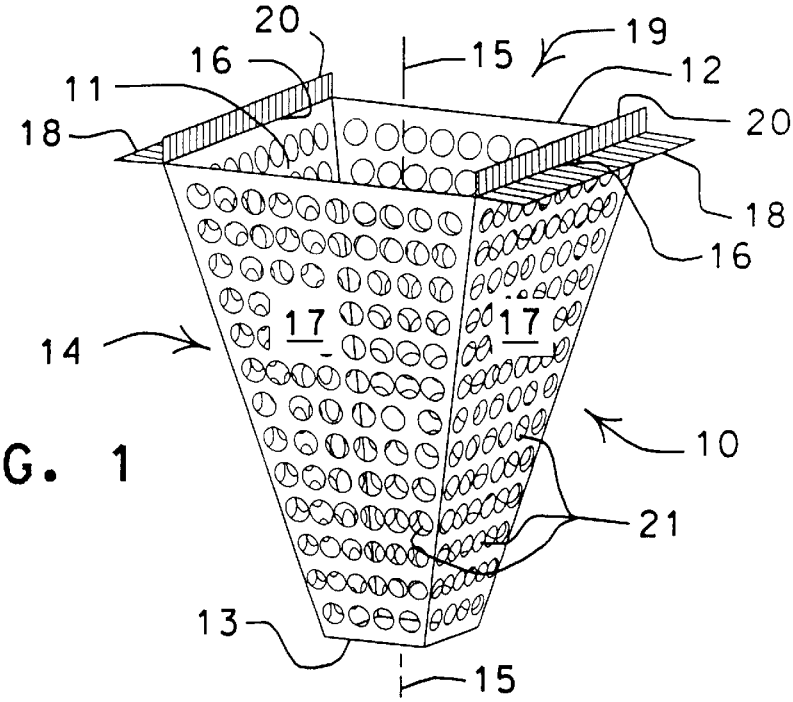
FIG. 1 is a top and side perspective view of an embodiment of the accumulating accessory useful in the stormwater receiving assembly of the present invention.
Figure 2:
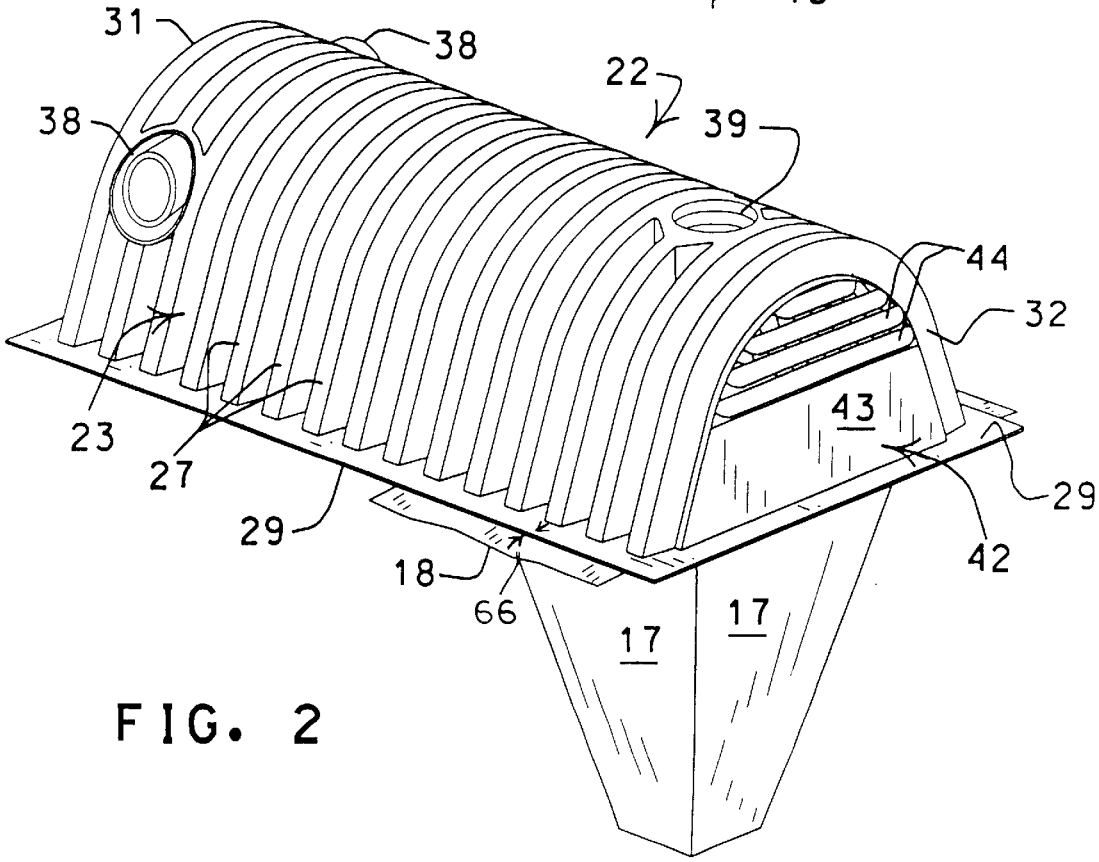
FIG. 2 is a top and side perspective view of an embodiment of the stormwater receiving assembly of this invention.

Referring now to FIG. 2, an embodiment of the stormwater receiving assembly of this invention is shown comprised of receiving chamber 22 and an accumulating accessory 10 positioned below said chamber. The accumulating accessory exemplified in FIG. 2, as best illustrated in FIG. 1, is shown as a monolithic structure fabricated of polyethylene, polypropylene or equivalent thermoplastic polymer and having a uniform thickness throughout of between 2 and 8 mm. The accumulating accessory is comprised of a compartment 11 having an open upper extremity 12 and closed lower extremity 13. Said compartment is further defined by sidewall structure 14 which is downwardly convergent upon center vertical axis 15. The degree of convergence is such that the cross-sectional area of the lower extremity, taken in a plane orthogonal to said axis is 10% to 40% of the cross-sectional area of said open upper extremity. The height of the accumulating accessory, measured between said upper and lower extremities is preferably between 20 and 72 inches. In alternative embodiments, the sidewall structure may be of non-convergent configuration, having a cylindrical or rectangular shape.

In the exemplified embodiment, said sidewall structure is comprised of four flat panels 17 disposed in an inverted pyramidal configuration, causing upper extremity 12 to have a rectangular perimeter 19 defined by straight edges 16.

Flat apron panels 18, emergent from opposed straight edges 16, are directed outwardly from said compartment within the plane of perimeter 19. Alignment means in the form of paired retaining lips 20 are emergent from said apron panels and directed upwardly from said compartment. Said retaining lips engage the interior surface of the associated chamber 22 adjacent its lowermost edge 25, thereby stabilizing the interaction of the chamber with the underlying accumulating accessory and further serving to achieve lateral alignment of said accessory with associated chamber 22. Additional alignment means, which may be in the form of indicia 66 on apron panels 18 and chamber 22, facilitate axial alignment of chamber 22 with respect to accessory 10. Sidewall structure 14 may be provided with a multitude of apertures 21 which facilitate drainage of water from said compartment. The diameter of the apertures may range from ⅛" to 1". The total area of said apertures preferably occupies between 1% and 10% of the total area of sidewall structure 14.

FIGS. 2–5 illustrate the manner in which the accumulating accessory 10 is combined with a stormwater dispensing chamber 22 for the purpose of increasing the amount of sediment that the chamber can hold, and also for facilitating the removal of such sediment from the chambers. Chamber 22 is comprised of a wall 23 extending upon a longitudinal axis between inlet and exit ends, 31 and 32, respectively, and having an arch shape cross-section with an upwardly directed peak 24, and opposed lowermost spaced apart parallel edges 25 which define an open bottom 26. Wall 23 has a multiplicity of corrugations 27 disposed in planes orthogonal to edges 25, thereby causing said wall to have increased compressive strength. Chambers useful in the practice of the present invention are fabricated preferably of polypropylene or high density polyethylene by way of thermal vacuum forming or gas assisted injection molding techniques, generally in accord with the technology described in U.S. Pat. Nos. 5,401,459; 5,087,151; 4,247,515; 4,234,642; 4,136,220 and 4,101,617. During molding, the plastic is configured to form a chamber having outwardly directed hollow ribs or corrugations 27. The disclosures of the foregoing patents are hereby incorporated by reference.

The chamber preferably has opposed axially elongated base panels 29 integral with said edges 25 of wall 23. Said base panels support the chamber, discouraging its descent into the underlying substrate.

The terminal or first rib or corrugation 30 adjacent inlet end 31 may be slightly larger than the multitude of ribs, and terminal rib 33 adjacent exit end 32 is slightly smaller than the multitude of ribs. Such configuration of the terminal ribs facilitates end-to-end joinder of successive chambers wherein vertical lowering of a chamber automatically causes the larger rib of one chamber to embrace the smaller rib of the next successive chamber.

Typical chambers of this invention may have a length of 6–12 feet measured between inlet and exit ends and a height up to 50 inches. The width of the chamber, measured between said opposed base panel 29, may range to 80 inches, including the width of said base panels.

Side inlet portal means 38 may be disposed in wall 23 for the purpose of accommodating horizontally disposed conduits that deliver stormwater to the chamber. Top portal means 39 is disposed in the peak of wall 23 adjacent exit end 32. Said top portal means is either a circular aperture or an indented portion of the wall which facilitates the cutting of a circular aperture. This permits visual observation of sediment level and removal thereof by vacuum equipment. The expression "adjacent exit end 32" is intended to denote a site along the horizontal length of the chamber which is within 20%, and preferably within 10% of the distance going from said exit end toward the opposed inlet end. The diameter of said portal means is preferably less than the diameter of the closed lower extremity 13 of said compartment.

The exit end 32 of the chamber may be provided with flow impeding means in the form of transverse panel 42, as best shown in FIG. 2, having a lower impervious portion 43 and an apertured upper portion 44. Said transverse panel functions to reduce the velocity of water flow, thereby causing sediment to accumulate in the area of exit end 32 of the chamber, and directly below top portal means 39.

Accumulating accessory 10 is functionally associated with a stormwater dispensing chamber as shown in FIGS. 2–5, wherein said chamber is positioned atop the accumulating accessory in a manner whereby base panels 29 of the chamber are caused to rest upon apron panels 18 of said accessory, and the paired retaining lips 20 of the accessory are disposed within said chamber in close adjacency to said base panels. It is to be further noted that the accessory is positioned such that its vertical axis 15 intersects the center of top portal means 39. The primary purpose of apron panels 18 is to provide support to the chamber by abutment with base panels 29. Such support is desirable because of the deformational stress caused by the loss of ground support because of the excavation 59 required to accommodate the accumulating accessory.

Figure 3:
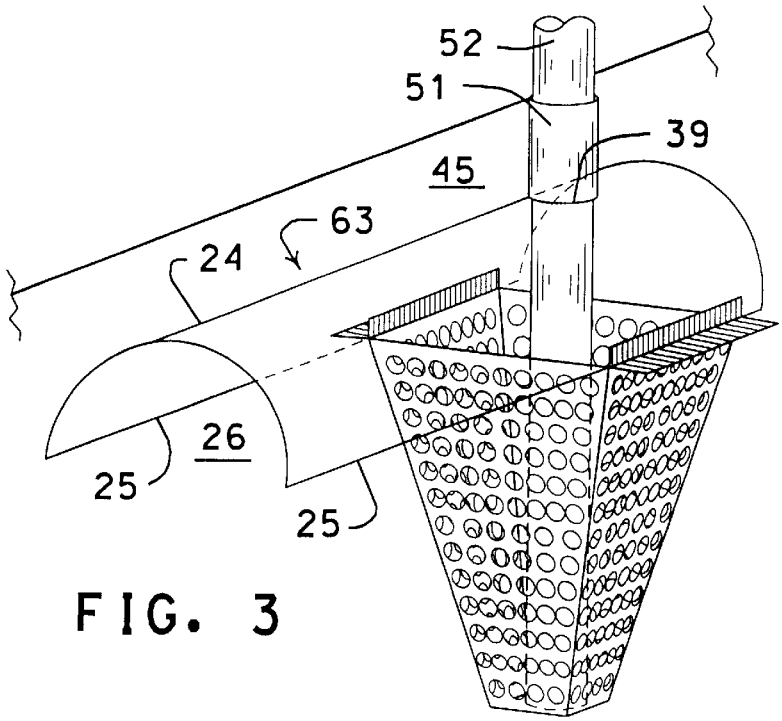
FIG. 3 is a schematic top and side perspective view of the embodiment of FIG. 2 shown in functional association with a suction tube that removes accumulated sediment.
Figure 4:
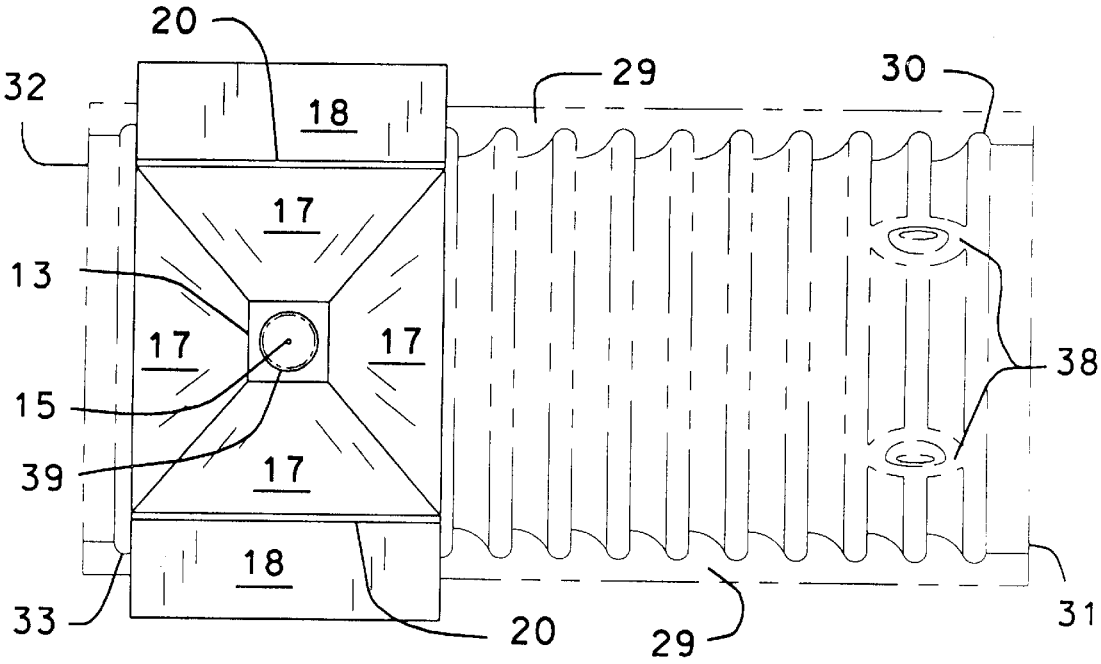
FIG. 4 is a top view of the assembly of FIG. 2 with the chamber component shown in phantom outline so as to reveal underlying features.
Figure 5:
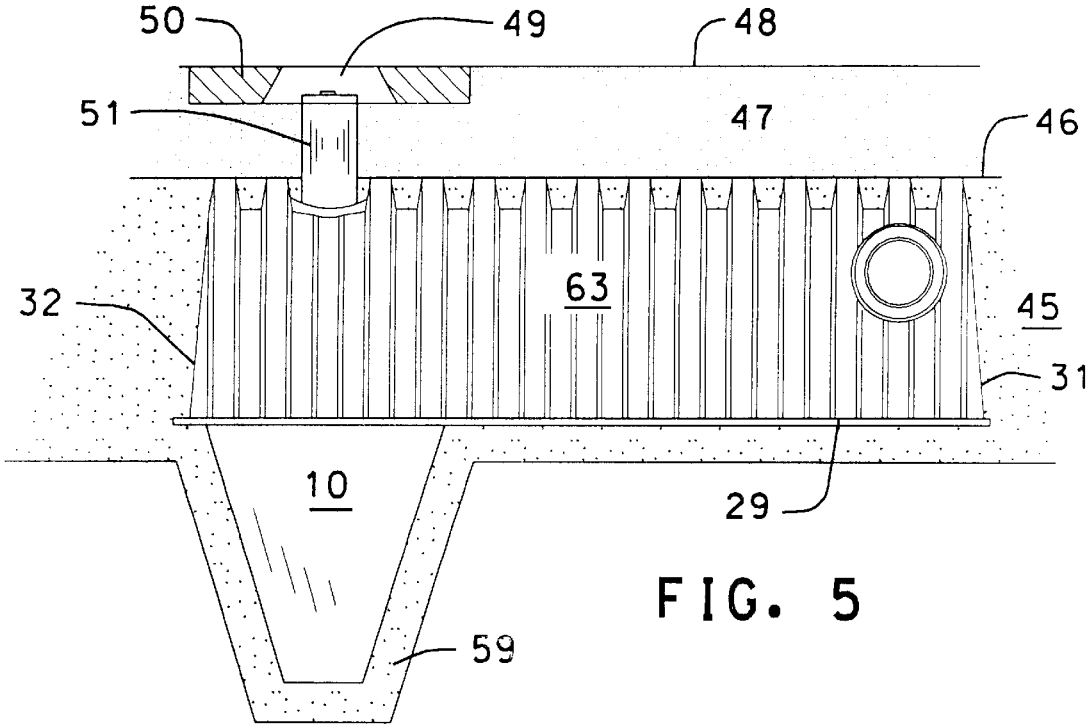
FIG. 5 is a side view of the assembly of FIG. 2 shown in schematic functional association with components of a stormwater leaching field.

As shown in FIGS. 3 and 5, the combined chamber and accumulating accessory of this invention is installed in an excavation upon a porous subterranean substrate such as crushed rock 45 that extends to the top of the chamber. A filter fabric 46 may be disposed atop the crushed rock substrate. A zone of compacted clean fill, gravel or crushed stone 47 extends from filter fabric 46 to an overlying layer such as pavement 48. A manhole 49 may be disposed in a concrete pad 50 centered above top portal means 39. A riser conduit 51 communicates between said manhole and top portal means. Accumulated sediment is removed from the chamber by causing a suction tube 52 to pass through conduit 51 to the bottom of the accumulating accessory. A vacuuming operation then transports the sediment upwardly into a servicing truck.

Figure 6:
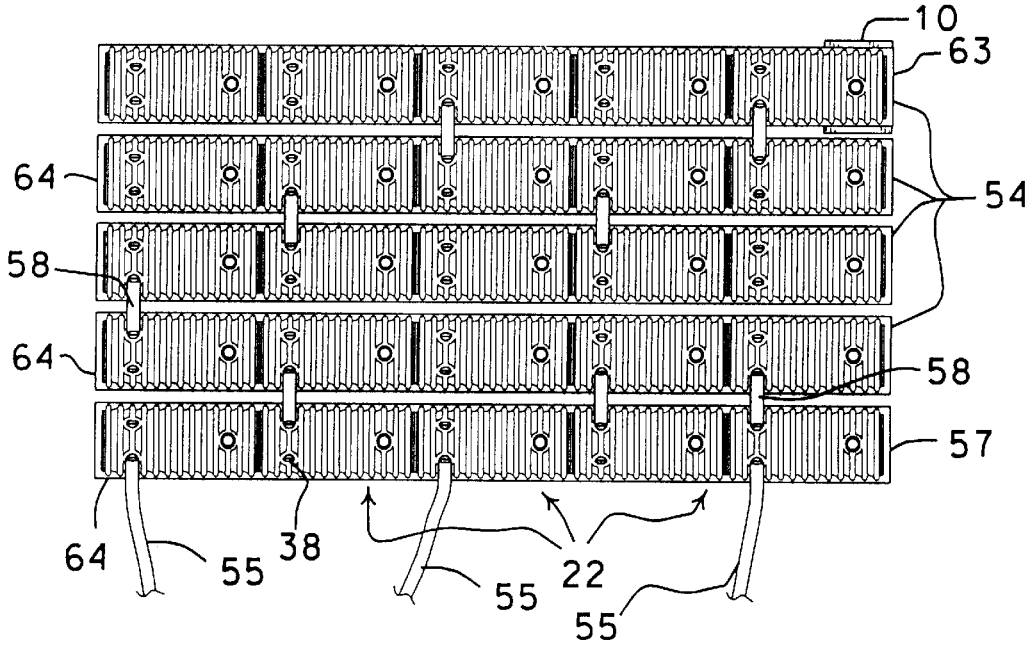
FIG. 6 is a plan view of a stormwater leaching field incorporating the stormwater receiving assembly of the present invention.

In a typical installation, as shown in a leaching field in FIG. 6, a multitude of the stormwater dispensing chambers are joined endwise to form long rows 54. A number of such rows are in side-by-side juxtaposition immersed within crushed rock substrate. Feeder conduits 55 deliver the water to the drainage field, conveying the water directly to side portals 38 in the sides of the chambers of outermost row 57. Water is then conveyed to other rows by way of interconnecting conduits 58 communicating between side portals of contiguous chambers.

Within each row 54, the first chamber 64 has an upstream or inlet extremity which is closed by an end wall. The successive chambers in the row, subsequent to the first chamber may have completely open inlet and exit ends. The exit end 32 of the last chamber 63 in a row has a completely closed end wall. This causes sediment to accumulate in the area of said exit end, and directly below top portal 32. Accordingly, within the leaching field, as shown in FIG. 6, the accumulating accessory is preferably employed with the last chambers 63 of the rows, which represent the downstream extremity of the overall flow pattern through a leaching field.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A stormwater receiving assembly for processing stormwater containing suspended particulate matter, comprising a) a dispensing chamber comprised of a plastic wall horizontally elongated between inlet and exit ends and having an arched cross-sectional shape with upwardly directed peak and spaced apart parallel lowermost edge extremities adapted to rest upon a porous subterranean substrate and defining an open bottom where said particulate matter settles, said peak having portal means to facilitate servicing of said chamber, and b) an accumulating accessory comprised of a compartment bounded by sidewall structure elongated upon a vertical axis between upper and lower extremities, said upper extremity being open and having a perimeter disposed in a plane orthogonal to said axis, c) said accumulating accessory being positioned below said dispensing chamber in a manner such that said portal means is in centered vertical alignment with the lower extremity of said compartment.

2. The assembly of claim 1 wherein said portal means is adjacent the exit end of said chamber.

3. The assembly of claim 1 wherein said plastic wall has a corrugated configuration.

4. The assembly of claim 1 wherein the sidewall structure of said compartment is downwardly convergent upon said vertical axis.

5. The assembly of claim 4 wherein the degree of convergence of said sidewall structure is such that the cross-sectional area of said lower extremity is 10% to 40% of the cross-sectional area of said upper extremity.

6. The assembly of claim 4 wherein the lower extremity of said compartment is closed.

7. The assembly of claim 6 wherein said sidewall structure has a multitude of apertures which facilitate drainage of water from said compartment.

8. The assembly of claim 7 wherein the total area of said apertures is between 1% and 10% of the total area of said sidewall structure.

9. The assembly of claim 1 wherein said sidewall structure is comprised of four flat panels joined in an inverted pyramidal configuration, causing the perimeter of said upper extremity to be of rectangular shape, as defined by four straight edges.

10. The assembly of claim 9 wherein a pair of flat apron panels are horizontally emergent from opposed straight edges of said rectangular perimeter and directed outwardly from said compartment within the plane of said perimeter.

11. The assembly of claim 10 wherein said dispensing chamber rests by abutment upon said apron panels.

12. The assembly of claim 1 wherein said accumulating accessory is further positioned below said dispensing chamber in a manner whereby the lowermost edge extremities of said dispensing chamber rest by abutment upon the upper extremity of said compartment.

13. The assembly of claim 1 wherein said portal means has a circular contour having a diameter smaller than the diameter of the lower extremity of said compartment.

14. The assembly of claim 1 further having alignment means for achieving centered vertical alignment of said portal means and the lower extremity of said compartment.

* * * * *